US005236112A

United States Patent [19]

Robinson et al.

[11] Patent Number: 5,236,112

[45] Date of Patent: Aug. 17, 1993

[54] BACK BAG

[75] Inventors: Doug Robinson, Scotts Valley, Calif.; Isamu Tatsuno, Osaka, Japan

[73] Assignee: Mont-Bell Co., Ltd., Osaka, Japan

[21] Appl. No.: 738,611

[22] Filed: Jul. 31, 1991

[51] Int. Cl.[5] ..... A45F 3/08

[52] U.S. Cl. ..... 224/211; 224/210

[58] Field of Search ..... 224/209, 210, 211, 212, 224/213, 215, 216, 261, 262, 263

[56] References Cited

U.S. PATENT DOCUMENTS

| | | | |
|---|---|---|---|
| 3,649,921 | 3/1972 | Thomas | 224/262 |
| 3,923,216 | 12/1975 | Farnbach | 224/211 |
| 4,303,186 | 12/1981 | Ollinger, IV . | |
| 4,982,884 | 1/1991 | Wise . | |

FOREIGN PATENT DOCUMENTS

| | | | |
|---|---|---|---|
| 3829145 | 3/1990 | Fed. Rep. of Germany | 224/213 |
| 2333464 | 7/1977 | France . | |
| 2464673 | 4/1981 | France | 224/215 |
| 2652727 | 4/1991 | France . | |
| 55-89322 | 6/1980 | Japan . | |
| 56-27029 | 3/1981 | Japan . | |
| 58-43885 | 10/1983 | Japan . | |
| 59-1533 | 1/1984 | Japan . | |
| 60-170124 | 11/1985 | Japan . | |
| 61-247409 | 11/1986 | Japan . | |
| 1-244709 | 9/1989 | Japan . | |
| 69067 | 2/1944 | Norway | 224/210 |
| 9105493 | 5/1991 | World Int. Prop. O. | 224/215 |

*Primary Examiner*—Linda J. Sholl
*Attorney, Agent, or Firm*—Fish & Richardson

[57] ABSTRACT

A back bag such as a back pack, knapsack or a rucksack has a bottom-equipped bag portion, a pair of shoulder straps provided on the body-contact side of the bag portion and adapted to be hung from the user's shoulders, and a substantially V-shaped frame provided on the body-contact side of the bag portion. The frame has both wing portions extending from the lower end apex of the V-form located in a region near the lower end of the backbone of the user's body. The wings being elastically deformable independently of each other with respect to the lower end apex of the V-form of the frame. The weight load is distributed over the area of the user's back, as well as to the shoulders. The frame is plastically deformable in conformity with the geometry of the user's back, so that the bag portion is held in close contact with the user's back without jumping or slipping sideways during a long-distance walk or climbing.

18 Claims, 3 Drawing Sheets

BACK BAG

BACKGROUND OF THE INVENTION

Field of the Invention

The present invention relates to a bag of the type which is carried on the back of a user by being suspended from the shoulders of the user, known as a knapsack, rucksack or back pack.

Description of the Related Art

In general, a back bag such as a knapsack has a pair of shoulder straps by which the bag is suspended from the users shoulders so as to be carried on the user's back. The back bag, particularly when it is designed for use in mountain climbing or trekking, has a bag portion of a comparatively large internal volume to contain a good deal of articles which heavily burdens the user for many hours during a long-distance walk or ascending or descending steep slopes. It is therefore desirable that the heavy load is uniformly distributed over the entire area of the user's back including shoulders and that such a uniform distribution is maintained during movement and action of the user's body.

To cope with such a demand, back bags have been proposed in, for example, Japanese Utility Model Publication Nos. 58-43885 and 59-1533, in which the positions of the pair of straps are adjustable in accordance with the size of the user's body. Back bags also have been proposed in which various reinforcements are provided on the side thereof contactable with the user's back, as disclosed, for example, in Japanese Utility Model Laid-Open Nos. 55-89322, 56-27029 and 60-170124, as well as in Japanese Patent Laid-Open No. 61-247409.

These known back bags, however, are designed and constructed such that the weight of the articles in the bag is borne mainly by the user's shoulders and no specific consideration is given to the behavior of the bag during movement or action of the user's body. Thus, there still exists a demand for further improvement in back bags of the type described.

SUMMARY OF THE INVENTION

Accordingly, it is an object of the present invention is to provide a back bag which enables the load of the articles in the bag to be uniformly distributed over the entire area of the user's back and which can be held in close contact with the user's back without being moved even during walking or vigorous action of the user's body, thereby overcoming the above-described problems of the prior art.

To this end, according to the present invention, there is provided a back bag comprising: a bag portion; a pair of shoulder straps provided on the body-contact side of the bag portion and adapted to be hung from the user's shoulders; and a substantially V-shaped frame provided on the body-contact side of the bag portion and having both wing portions extending from the lower end apex of the V-form located in a region near the lower end of the backbone of the user's body, the wings being elastically deformable independently of each other with respect to the lower end apex of the V-form of the frame.

Preferably, each of the wings of the frame is plastically deformable at least in the longitudinal direction thereof in conformity with the geometry of the user's back, by application of a force falling within a predetermined range.

By virtue of th provision of the substantially V-shaped frame, the load, i.e., the weight of the articles in the bag, is uniformly distributed over the back of the user through the lower end apex of the V-form of the frame and through the pair of shoulder straps. The lower end apex of the V-form of the strap is located in a region near the lower end of the backbone of the user. This region has the highest rigidity in the skeletal structure of the human body and, hence, can provide a stable support for the load. It is therefore possible to minimize the fatigue, as well as any unpleasantness, of the user during a long use. In addition, since both wing portions of the substantially V-shaped frame can elastically deform independently of each other, the frame can be deflected in such a manner as to follow a motion of the user's back during, for example, walking, whereby the bag portion can be stably held on the user's back without movement such as sliding sideways.

Furthermore, since each wing of the frame is plastically deformable at least in the longitudinal direction thereof, the user can adjust the frame in conformity with the geometry of his back so as to ensure that the content of the bag portion can stably held on the user's back in close contact therewith.

The above and other objects, features and advantages of the present invention will become clear from the following description of the preferred embodiment when the same is read in conjunction with the accompanying drawings.

DESCRIPTION OF THE PREFERRED EMBODIMENT

The invention will be described in detail with reference to the accompanying drawings which show an embodiment of the present invention.

Figure 1:
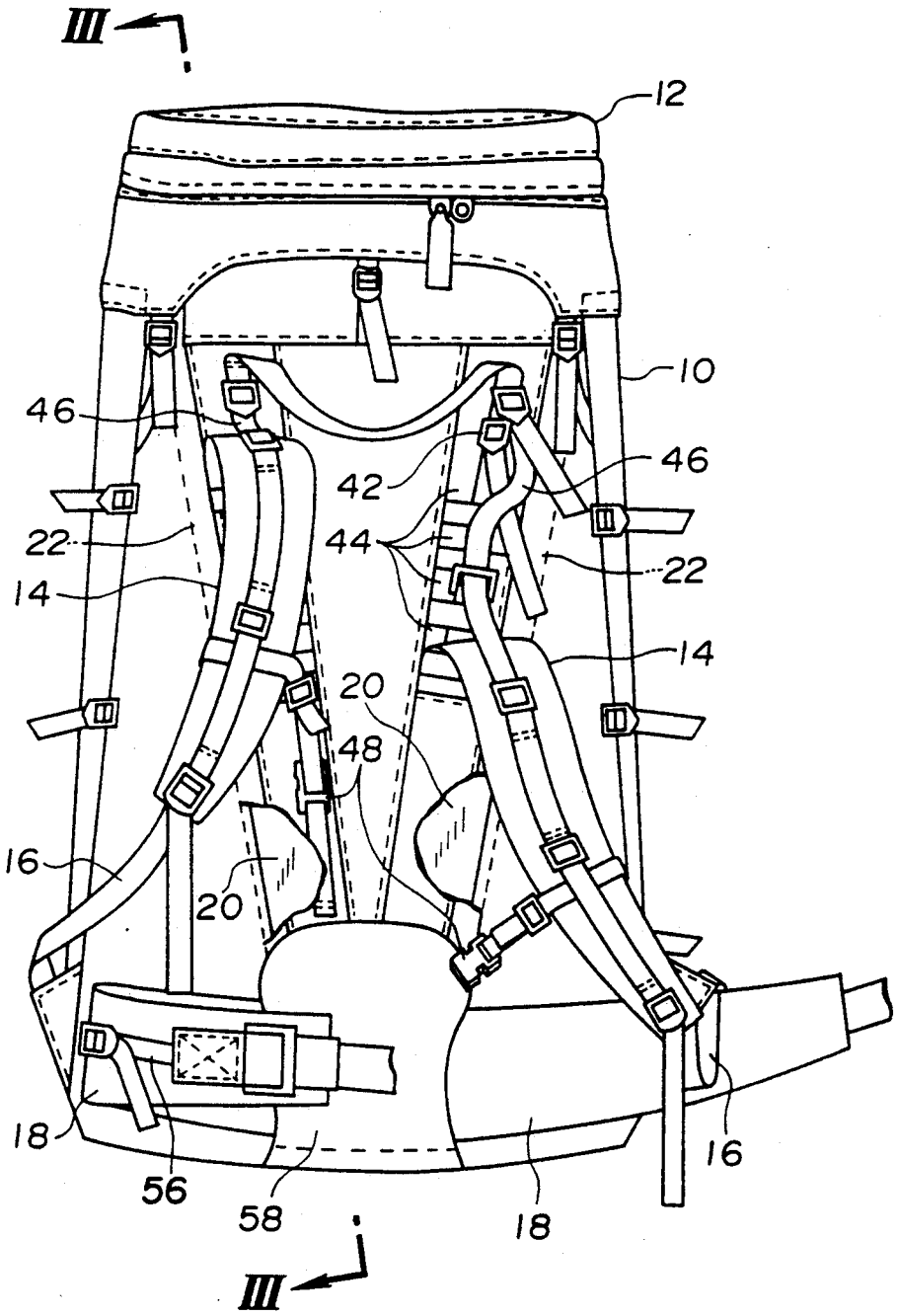
FIG. 1 is an elevational view of an embodiment of the back bag in accordance with the present invention, as viewed from the side adjacent the user's body.

FIG. 1 illustrates an embodiment of the back bag of the present invention, more specifically a back bag of the type generally referred to as "back pack", as viewed from the side adjacent the user's body (referred to as "body-contact side" hereinafter). The back bag has a bag portion 10 which is usually made of a woven or non-woven fabric of natural or synthetic fibers so as to have suitable levels of flexibility and rigidity. The bag portion 10 has a generally tubular form with a bottom, and is designed to have a detachable cover 12 on the top thereof. The body-contact side of the bag portion 10 is generally flattened and is provided with a pair of shoulder straps 14 connected thereto. More specifically, the shoulder straps 14 are connected through webbings 16 to both lateral lower end portions of the bag portion 10 so as to be suspended from the user's shoulders in symmetry. A hip belt 18 provided on the lower end of the bag portion 10 has portions which extend to the left and right from the respective lateral lower ends of the bag portion 10 at the body-contact side so as to surround the hip bone of the user when the back bag is used.

Figure 2:
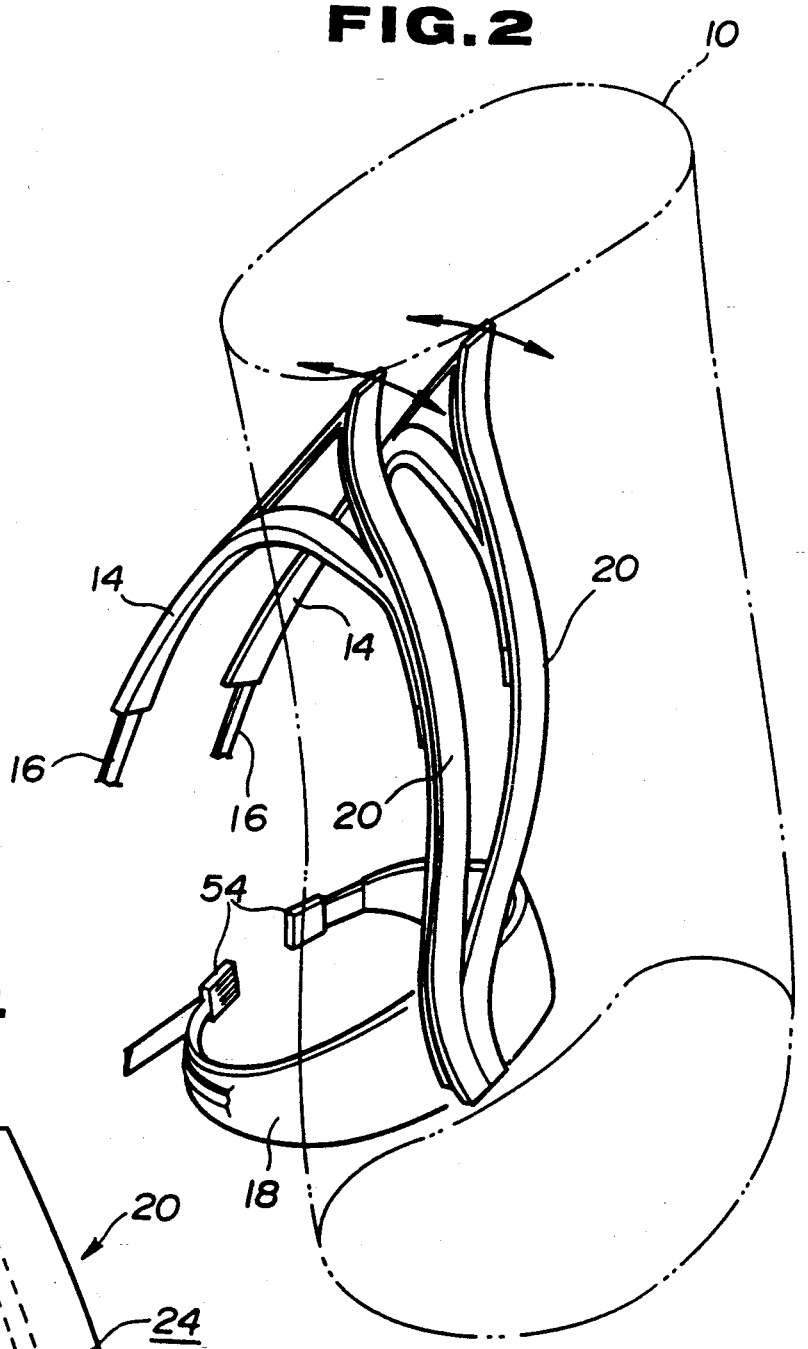
FIG. 2 is a perspective view of a critical portion of the embodiment.
Figure 4:
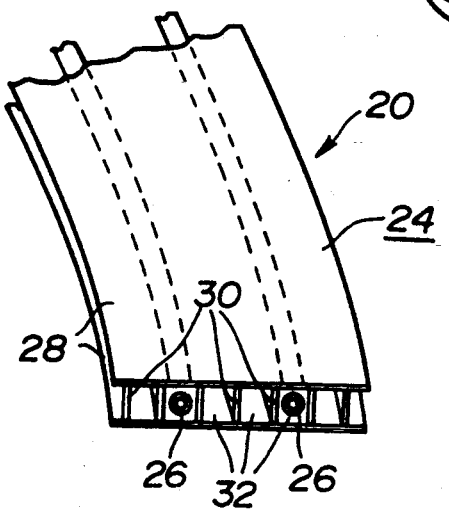
FIG. 4 is a partly-sectioned perspective view of a portion of a frame which forms one of the critical portions of the embodiment.
Figure 3:
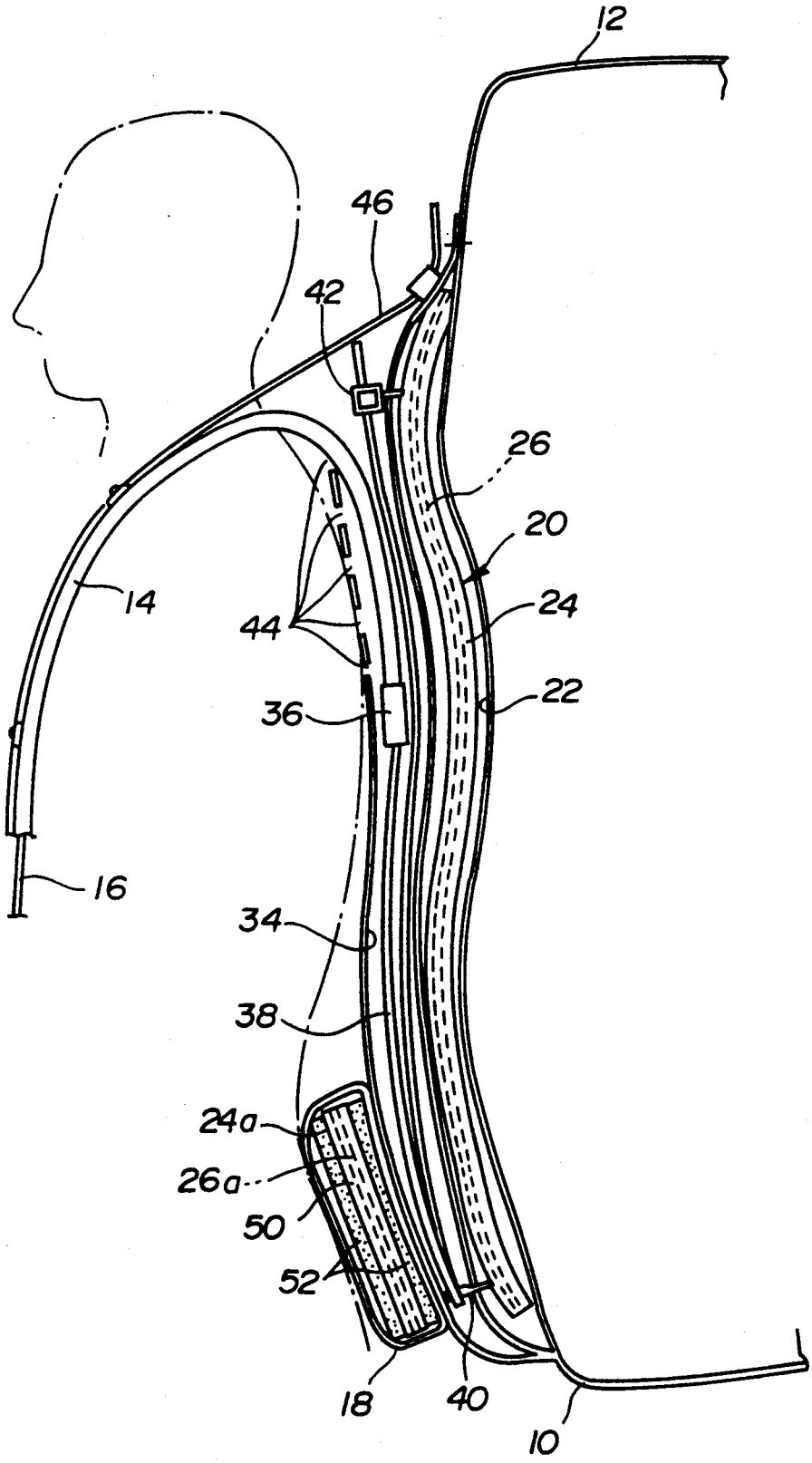
FIG. 3 is a sectional view taken along the line III—III of FIG. 1.

Referring to FIGS. 2 to 4, a substantially V-shaped frame 20 is provided on the body-contact side of the bag portion 10 so as to lie in symmetry with respect to the longitudinal axis of the bag portion 10. A pair of frame-receiving sheathes 22, arranged in a generally V-like form, are provided in the body-contact side wall of the bag portion 10 so as to receive respective inclined straight wing portions of the frame 20, as shown in FIG. 3. Thus, both wing portions of the V-shaped frame 20 are received in the respective frame-receiving sheathes 22. In the illustrated embodiment, both lower ends of the wing portions of the V-shaped frame 20 are not connected to each other. The lower end or apex of the V-shape where these inclined straight portions meet each other is positioned such that it is located in the vicinity of the lower end of the backbone of the user's body when the back bag is used.

As will be seen from FIG. 4, each wing portion of the frame 20 has a web-like frame body 24 including thin-walled and light-weight walls 28 of a synthetic resin and soft metallic members 26 extended through the frame body 24. The frame body 24 is made of a suitable synthetic resin which provides suitable levels of elasticity and rigidity.

The metallic members 26 is made of a suitable metallic material which, when assembled in the frame body 24, plastically deforms under a predetermined ranges of force applied thereto, so as to maintain the frame 20 in the deformed state against the rigidity of the frame body 24 even after the removal of the force. More specifically, the frame body 24 is preferably but not exclusively made of a thermoplastic resin, particularly polyethylene or polypropylene. The metallic member 26 is preferably a rod, wire or pipe of aluminum, although other suitable metallic materials in various forms are usable.

As will be seen from FIG. 4, the frame body 24 has a plurality of partitions 20 which interconnect both walls 28 and which define a plurality of bores 32 extending in the longitudinal direction of the frame body 24. Such a frame body is commercially available without any difficulty. The metallic members 26 are inserted into and received in these bores 26. It is not necessary that all these bores 32 receive the metallic members 26. Thus, the number and positions of the metallic members are to be determined in relation to the nature of the frame body 24, so as to enable a required plastic deformation of the whole frame 20 at least in the longitudinal direction under a predetermined range of force as described before and so as to minimize the weight of the whole frame 20. In the frame 20 thus constructed, the frame body 24 gives structural strength and rigidity to the body-contact side of the bag portion 10, while the soft metallic members 26 allows the frame 20 to flex to a form conforming with the geometry of the user's back and to maintain this form. Thus, the user can adjust the form of the frame 20 by hand, without using any specific tool, so as to adapt it to the form of the user's back. This adjustment can be done while the frame 20 is set in the bag portion 10. The adjustment, however, can be done more easily when the wing portions of the frame 20 are easily extracted from the bag body 10.

The aforementioned shoulder straps 14 are disposed to oppose both wing portions of the substantially V-shaped frame 20. As will be best seen from FIG. 3, the base end portion of each shoulder strap 14 is received in a strap-receiving sheath 34 which is formed immediately on the frame-receiving sheath 22 for receiving corresponding wing of the V-shaped frame 20. The end extremity of the base end of the strap 14 is connected, through a reinforcement plate 34 made of, for example, a synthetic resin, to a webbing 38 which extends to the bottom of the strap-receiving sheath 34. The webbing 38, after making a turn on a turn piece 40 provided at the bottom of the strap-receiving sheath 34, extends upward so as to be connected to an adjustable buckle 42 which enables adjustment of the length of the strap. Preferably, the turn piece 40 and the buckle 42 are fixed to the corresponding wing of the V-shaped frame 20. The buckle 42 is exposed to the outside of the back bag. The user, therefore, can pull or push the webbing into and out of the bag by means of the buckle 42 so as to adjust the length of each shoulder strap projecting from the body-contact side of the bag portion 10. The upper end region of the strap-receiving sheath 34 is cut at a plurality portions so as to provide openings 44 substantially at a constant pitch in the heightwise direction. Each of these openings 44 can function as an outlet through which the shoulder strap 14 is extracted. It will be seen that the heightwise position at which the shoulder strap extends apart from the body-contact side of the bag portion 10 is adjustable by selection of the outlet opening 44. In FIG. 1, the shoulder strap 14 which is on the left hand side as viewed in FIG. 1 is led from the uppermost outlet opening 44, whereas the right hand side shoulder strap 14 is led through the lowermost outlet opening 44.

Since the shoulder straps are secured to the bag portion 10 in alignment with the respective wings of the V-shaped frame 20, part of the load of the articles in the bag portion 10 is uniformly shared by both shoulder straps 14, whereas the remainder part of the load is mainly borne by the portion of the user's body near the lower end of the backbone, since the lower end of the substantially V-shaped frame 20 is located near the lower end of the backbone. As a consequence, concentration of the load to the shoulders, which has been inevitable in known back bags, is avoided. When the user stoops or straightens his back during walking or other motion, the change in the form of the user's back is transmitted to the frame 20 through the shoulder straps 14. Since both wings of the substantially V-shaped frame 20 are freed from each other at their lower ends, and since these wings are elastically deformable independently of each other as indicated by arrows in FIG. due to the nature peculiar to the frame, the wings of the frame 20 can easily be deformed following up the change in the configuration of the user's back to enable the body-contact side of the bag 10 to fit on the user's back, thus preventing the bag portion from jumping off the user's back or sliding sideways on the user's back.

Referring to FIG. 1, numeral 46 denotes a reinforcement strap which serves to stably fix each shoulder strap 14 to the body-contact side of the bag portion 10, while 48 denotes buckles which serve to prevent the pair of shoulder straps 14 from moving apart from each other when they are hung from the user's shoulders.

In order to hold the lower end portion of the bag portion 10 in close contact with the user's body, the illustrated embodiment employs the hip belt 18 as explained before. The hip belt 18 has its center located near the lower end of the backbone of the user's body, i.e., in alignment with the lower end of the substantially V-shaped frame 20. The hip belt 18 has portions which extend from the center to the left and light. Referring specifically to FIG. 3, the hip belt 18 has a reinforcement frame 50 which is composed of, as in the case of the frame 20, a frame body 24*a* of thin synthetic resinous walls, and metallic members 26*a* embedded in the frame body 24*a*, the reinforcement frame 50 being sandwiched between sheets of a buffering material such as sponge. In this hip belt 18, the metallic members 26*a* are plastically deformable along the length of the hip belt so that the configuration of the hip belt 18 can be adjusted in conformity with the geometry of the user's hip. In this embodiment, therefore, the load of the articles in the bag portion 10 is distributed also to the hip belt 18 through the substantially V-shaped frame 20 so as to be uniformly distributed to the region near the lower end of the backbone, as well as around the hip bone, of the user's body, thus enabling the load to be carried stably.

In FIG. 2, numeral 54 denotes a buckle through which the opposing ends of both extending portions of the hip belt 18 are connected together. In FIG. 1, numeral 56 denotes reinforcement straps for securely connecting the hip belt 18 to the bag portion 10, while numeral 58 denotes a back pad which fixes the central portion of the hop belt 18 to the bag portion 10 and which is held in direct contact with the lower end of the user's back.

Although a back pack with a hip belt has been described as an embodiment, it will be clear that the described embodiment is only illustrative and the invention can equally be applied to various other types of back bags such as a back pack having no hip belt, a knapsack or a rucksack.

As has been described, the back bag in accordance with the present invention has a substantially V-shaped frame which is provided on the body-contact side of the bag portion and which has a pair of wings extending from the lower end or apex of the V-form and which are elastically deformable independently of each other. The frame serves to reduce the proportion of the load transmitted to the user's shoulders through the shoulder straps and enables the bag portion and, hence, the content, to be carried on the user's back in close contact therewith, well following up the movement of the user's back during walking or other action.

Furthermore, the frame is plastically deformable at least along the length thereof by application of a predetermined range of force so that the frame can be adjusted to make the configuration of the body-contact side of the bag portion conform with the geometry of the user's back, thus enabling the load to be distributed over the entire area of the back to eliminate concentration of the load to any local portion of the user's body.

What is claimed is:

1. A back bag comprising:

a bag portion;

a pair of shoulder straps provided on a body-contact side of said bag portion and adapted to be hung from a user's shoulders; and a substantially V-shaped frame provided on the body-contact side of said bag portion and having a pair of wing portions, each wing portion separate from one another, and extending from a lower apex of the V-shaped frame located in a region of the back bag for contacting the lower end of the backbone of the user's body, said wing portions being elastically deformable independently of each other with respect to said lower apex of the V-shaped frame.

2. A back bag according to claim 1, wherein each of said wings of said frame is plastically deformable in a longitudinal direction thereof in conformity with the geometry of the user's back, by application of a force falling within a predetermined range.

3. A back bag according to claim 2, wherein each wing of said frame has a thin walled web-like frame body made of a synthetic resin and at least one bore extending through said frame body in the longitudinal direction thereof, and a soft metallic member received in said bore.

4. A back bag according to claim 3, wherein said frame body is made from a thermoplastic resin so as to have a pair of opposing walls and a plurality of partitions which are disposed at a predetermined pitch so as to interconnect both walls so that a plurality of said bores are defied by said walls and adjacent partitions.

5. A back bag according to claim 3, wherein said metallic member is a rod or a pipe of aluminum.

6. A back bag according to claim 1, further comprising a pair of frame-receiving sheathes arranged in a substantially V-like form on the body-contact side of said bag portion, said wings of said frame being independently received in respective frame-receiving sheathes so as to generally form a V-shape.

7. A back bag according to claim 1, wherein said shoulder straps are materially connected to said frame such that the weight of said bag portion is transmitted through said frame.

8. A back bag according to claim 1, further comprising means for enabling adjustment of the length of each shoulder strap projecting from said body-contact side of said bag portion.

9. A back bag according to claim 8, wherein a base end of each said shoulder strap is turned around a turn piece provided on a lower end of said frame and then connected to an adjusting member connected to an upper end of an associated wing of said frame, said adjusting member enabling adjustment of the length of projection of said shoulder strap through adjustment of the position of the base end of said shoulder strap.

10. A back bag according to claim 1, further comprising a hip belt provided on a lower portion of said body-contact side of said bag portion at the lower apex of the substantially V-shaped frame and having portions which surround the hip bone of the user's body, said hip belt being materially connected to said frame so that a portion of the weight of said bag portion is transmitted to said hip belt through said frame.

11. A back bag according to claim 10, wherein said hip belt includes a second frame which is composed with a thin-walled web-like frame body made of a synthetic resin and having at least one bore formed therein and a soft metallic member received in said bore.

12. A back bag according to claim 11, wherein said hip belt is elastically deformable about its center which is located near the lower apex of the V-shaped frame.

13. A back bag comprising:

a bag portion;

a pair of shoulder straps provided on a body-contact side of said bag portion and adapted to be hung from a user's shoulders; and a substantially V-shaped frame provided on the body-contact side of said bag portion and having a pair of wing portions, each wing portion separate from one another, and extending from a lower apex of the V-shaped frame located in a region of the back bag for contacting the lower end of the backbone of the user's body, said wing portions being elastically deformable independently of each other with respect to said lower apex of the V-shaped frame, wherein each wing of said frame has a thin walled web-like frame body made of a synthetic resin and at least one bore extending through said frame body in a longitudinal direction, and a soft metallic member received in said bore.

14. A back bag according to claim 13, wherein said frame body is made from a thermoplastic resin so as to have a pair of opposing walls and a plurality of partitions which are disposed at a predetermined pitch so as to interconnect both walls so that a plurality of said bores are defined by said walls and adjacent partitions.

15. A black bag according to claim 13, wherein said metallic member is a rod or a pipe of aluminum.

16. A black bag comprising:

a bag portion;

a pair of shoulder straps provided on a body-contact side of said bag portion and adapted to be hung from a user's shoulders;

a substantially V-shaped frame provided on the body-contact side of said bag portion and having a pair of wing portions, each wing portion separate from one another, and extending from a lower apex of the V-shaped frame located in a region of the back bag for contacting the lower end of the backbone of the user's body, said wing portions being elastically deformable independently of each other with respect to said lower apex of the V-shaped frame; and means for adjusting shoulder strap length, wherein a base end of each shoulder strap is turned around a turn piece provided at a lower end of said frame and is connected to an adjusting member which is connected to an upper end of an associated wing of said frame.

17. A back bag comprising:

a bag portion;

a pair of shoulder straps provided on a body-contact side of said bag portion and adapted to be hung from a user's shoulders;

a substantially V-shaped frame provided on the body-contact side of said bag portion and having a pair of wing portions, each wing portion separate from one another, and extending from a lower apex of the V-shaped frame located in a region of the back bag for contacting the lower end of the backbone of the user's body, said wing portions being elastically deformable independently of each other with respect to said lower apex of the V-shaped frame; and a hip belt provided on a lower portion of said body-contact side of said bag portion and connected to said frame so that a portion of said bag portion is transmitted to said hip belt through said frame, wherein said hip belt includes a second frame which is composed with a thin-walled web-like frame body made of a synthetic resin, having at least one bore formed therein and a soft metallic member received in said bore.

18. A back bag according to claim 17, wherein said hip belt is elastically deformable about its center which is located near a lower apex of the V-shaped frame.

* * * * *